US005248211A

United States Patent [19]

Holst

[11] Patent Number: 5,248,211

[45] Date of Patent: Sep. 28, 1993

[54] WINDSHIELD CLEANER

[76] Inventor: Arthur C. Holst, 2024 McCord St., Murphysboro, Ill. 62966

[21] Appl. No.: 939,161

[22] Filed: Sep. 2, 1992

[51] Int. Cl.[5] ..... A47L 13/19; A47L 1/06; A47L 1/15

[52] U.S. Cl. ..... 401/7; 15/227; 15/232; 401/184; 401/188 R

[58] Field of Search ..... 401/188 R, 7, 8, 184; 15/227, 232, 208, 209.1

[56] References Cited

U.S. PATENT DOCUMENTS

| | | | |
|---|---|---|---|
| 744,455 | 11/1903 | Alwart | 401/8 |
| 1,554,510 | 9/1925 | Kirby | 15/227 X |
| 4,620,528 | 11/1986 | Arraval | 401/7 X |

FOREIGN PATENT DOCUMENTS

| | | | |
|---|---|---|---|
| 620021 | 10/1935 | Fed. Rep. of Germany | 401/7 |
| 1397340 | 3/1965 | France | 401/7 |
| 251415 | 5/1926 | United Kingdom | 15/227 |

*Primary Examiner*—Steven A. Bratlie
*Attorney, Agent, or Firm*—S. Michael Bender

[57] ABSTRACT

A device for cleaning the inside surface of an automobile windshield comprising a rigid support member in the form of a tapered housing having a generally triangular shaped cross-section in a first transverse plane and a rectangular shaped cross-section in a second transverse plane othogonally related to the first plane, and a replaceable flexible cover fitted on the support member having a first portion of cleaning material and a second portion of drying and/or polishing material. In an alternative arrangement, a self-contained cleaning substance storage reservoir is disposed between the cover and the support member and a manually activatable flexible bulb is provided for facilitating selective transfer of the cleaning substance from the reservoir to the cover for eventual application to the inside surface of an automobile windshield.

9 Claims, 4 Drawing Sheets

WINDSHIELD CLEANER

BACKGROUND OF THE INVENTION

1. Field of the Invention

The present invention relates generally to cleaning devices, and more particularly, to a device especially adapted to effectively and efficiently clean the inside surface of automobile windshields.

2. Description of the Prior Art

Devices for facilitating cleaning, waxing, polishing, etc. of the various surfaces of an automobile windshield are quite well known. Typically, one class of such appliances generally takes the form of a mitt of fabric or other flexible material fitted about the hand as described, for example, in U.S. Pat. Nos. 4,670,930 (Lu); 4,959,881 (Murray); 4,807,322 (Littledeer); and 3,638,789 (Tuszewski).

Each of these prior art cleaning devices suffers from the disadvantage of not being able to efficiently clean the inside surface of an automobile windshield because of their flexible construction which prevents optimal constant area contact between the fabric of the mitt and the sharply raked surface of the windshield. Rigid windshield cleaning devices are known as evidenced, for example, by U.S. Pat. Nos. 4,240,176 (Farmer) and 4,742,595 (Issacs), but these usually comprise a "squeegee" or the like mounted on the end of a stick, and thus, do not have a geometrical configuration ideally suited for reaching and effectively cleaning the awkwardly angled inside surface of the typical windshield.

Clearly a need exits for an automobile windshield cleaning device which exhibits the shape of and is fitted as a mitt so as to reach the hard to get at portions of the inside surface of the windshield, yet is rigid enough to maintain efficient surface cleaning contact as the mitt is wiped over the windshield surface by hand.

The foregoing need is met by the unique windshield cleaner of the present invention as will be made apparent from the following description thereof. Other advantages of the present invention over the prior art also will be rendered evident.

SUMMARY OF THE INVENTION

To achieve the foregoing and other advantages, the present invention, briefly described, provides a device for cleaning the inside surface of an automobile windshield comprising a rigid support member in the form of a tapered housing having a generally triangular shaped cross-section in a first transverse plane and a rectangular shaped cross-section in a second transverse plane orthogonally related to the first plane, and a replaceable flexible cover for said support member having a first portion of cleaning material and a second portion of drying and/or polishing material. In an alternative arrangement, a self-contained cleaning substance storage reservoir is disposed between the cover and the support member and a manually activatable flexible bulb is provided for facilitating selective transfer of the cleaning substance from the reservoir to the cover for eventual application to the inside surface of an automobile windshield.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will form the subject matter of the claims appended hereto.

In this respect, before explaining at least two preferred embodiments of the invention in detail, it is to be understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

It is therefore an object of the present invention to provide a new and improved windshield cleaner which has all of the advantages of the prior art and none of the disadvantages.

It is another object of the present invention to provide a new an improved windshield cleaner which may be easily and efficiently manufactured and marketed.

It is a further objective of the present invention to provide a new and improved windshield cleaner of inexpensive and reliable construction.

An even further object of the present invention is to provide a new and improved windshield cleaner which is susceptible of a low cost of manufacture with regard to both materials and labor, and which accordingly is then susceptible of low prices of sale to the consuming public, thereby making such windshield cleaner readily available to the buying public.

Still yet a further object of the present invention is to provide a new and improved windshield cleaner which has all of the advantages of a flexible mitt adapted to be worn on and manipulated by the hand, yet has none of its disadvantages as enumerated above.

It is still a further object of the present invention is to provide a new and improved windshield cleaner having a rigid support member covered by a flexible cleaning cover and which may be manipulated as a mitt to efficiently clean the inside surface of an automobile windshield.

Still a further object of the present invention is to provide a new and improved windshield cleaner having a self-contained supply of cleaning substance capable of being selectively supplied to the surface being treated or cleaned.

Still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawings wherein.

DESCRIPTION OF THE PREFERRED EMBODIMENT

With reference now to the drawings, a new and improved windshield cleaner embodying the principles and concepts of the present invention will be described.

Figure 1:
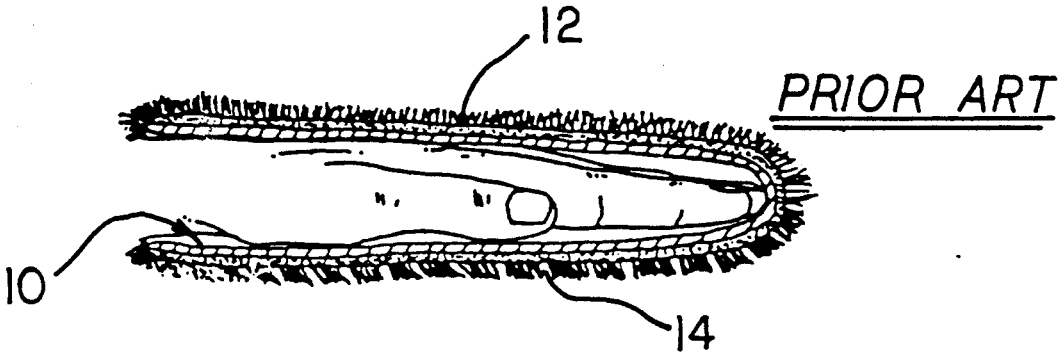
FIG. 1 is a cross-sectional view showing a prior art cleaning mitt.

Before proceeding to describe in detail the preferred embodiments of the present invention, it might be helpful to first briefly describe typical prior art arrangements of mitt-type windshield cleaning devices. Thus, as shown in FIG. 1, a typical prior art device comprises a flexible mitt or glove 10 having different first and second outer surfaces 12, 14 for cleaning different materials, respectively.

Figure 2:
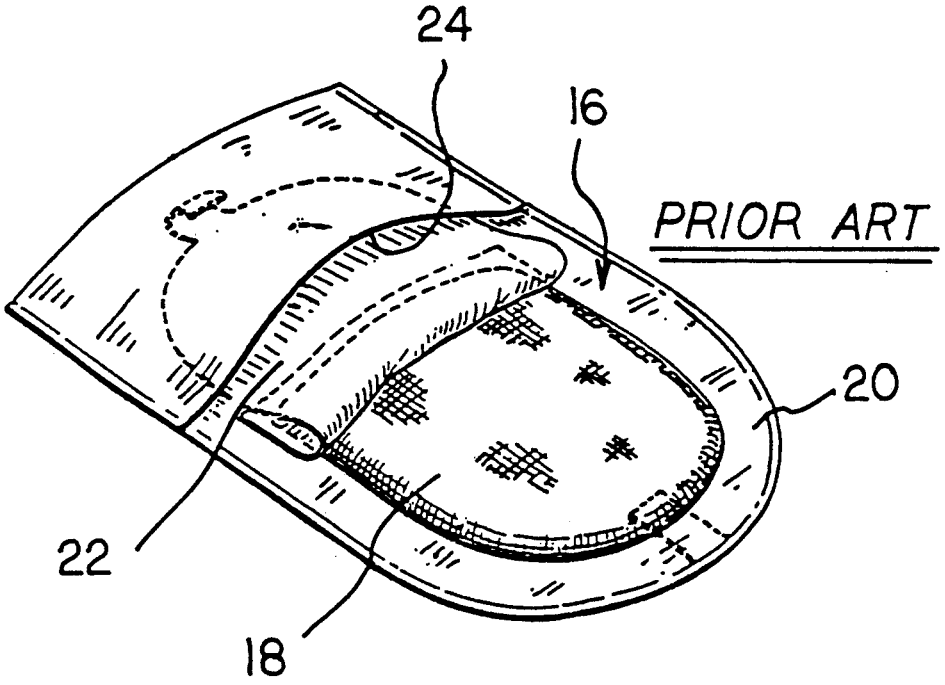
FIG. 2 is a perspective view showing another prior art cleaning mitt
Figure 3:
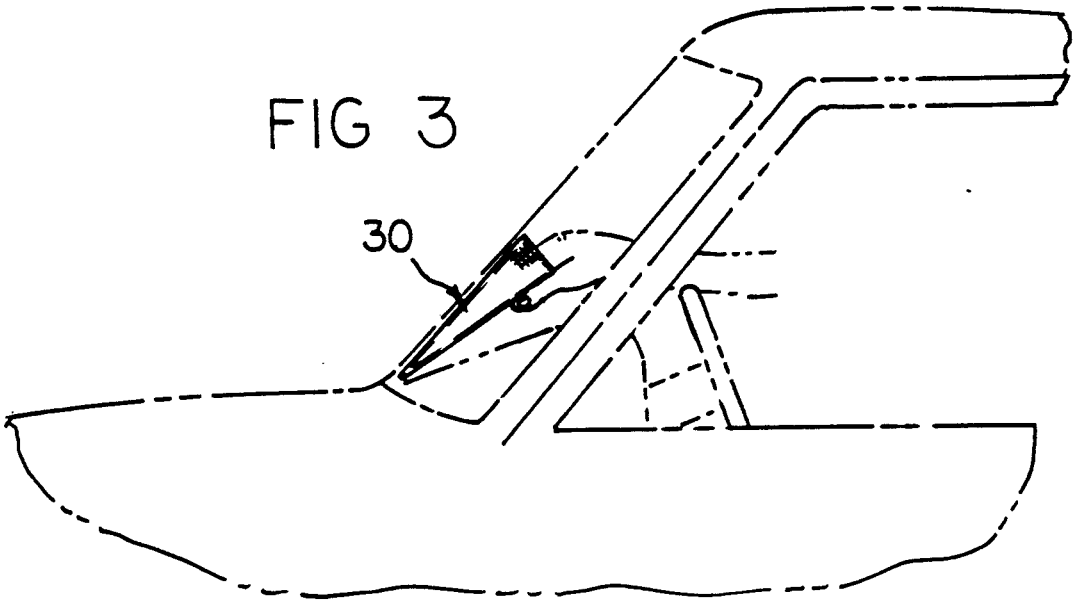
FIG. 3 is a schematic diagrammatic view showing how the unique windshield cleaner of the present invention is employed to clean the inside surface of an automobile windshield.
Figure 4:
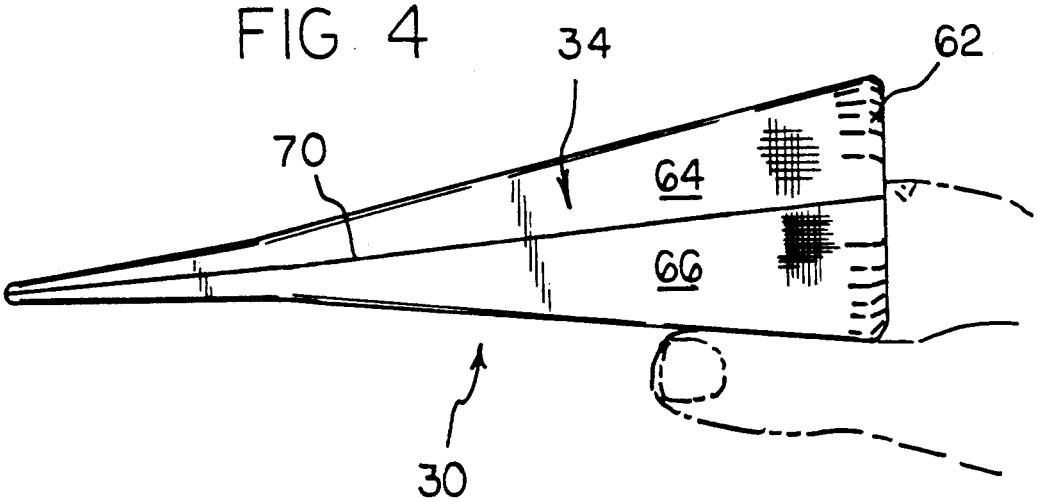
FIG. 4 is a elevational side view of the first preferred embodiment of the present invention.

Turning to FIG. 2, yet another prior art cleaning device is shown comprising a flexible mitt or glove 16 having a pad 18 of material permeated with a cleaning solution of one outer surface 20 and a protective flap 22 which may be folded back to expose the pad and tucked into fold 24 during use.

It will be appreciated that due to the flexible construction of each of the foregoing prior art devices, cleaning of the inside surface of an automobile windshield is difficult due to the combination of several factors including the sharply raked angle of the windshield and the inability of the irregular shaped portions of the hand to maintain uniform or constant area contact between the mitt's outer surface and the windshield surface as the mitt is wiped over the windshield surface.

Turning now to FIGS. 3-6, there is shown a first exemplary embodiment of the windshield cleaner of the present invention generally designated by reference numeral 30. In its preferred form, windshield cleaner 10 comprises a rigid support member generally designated by reference numeral 32 and a flexible cover generally represented by reference numeral 34 adapted to be fitted about the support member 30 to provide an outer cleaning surface therefor.

Figure 5:
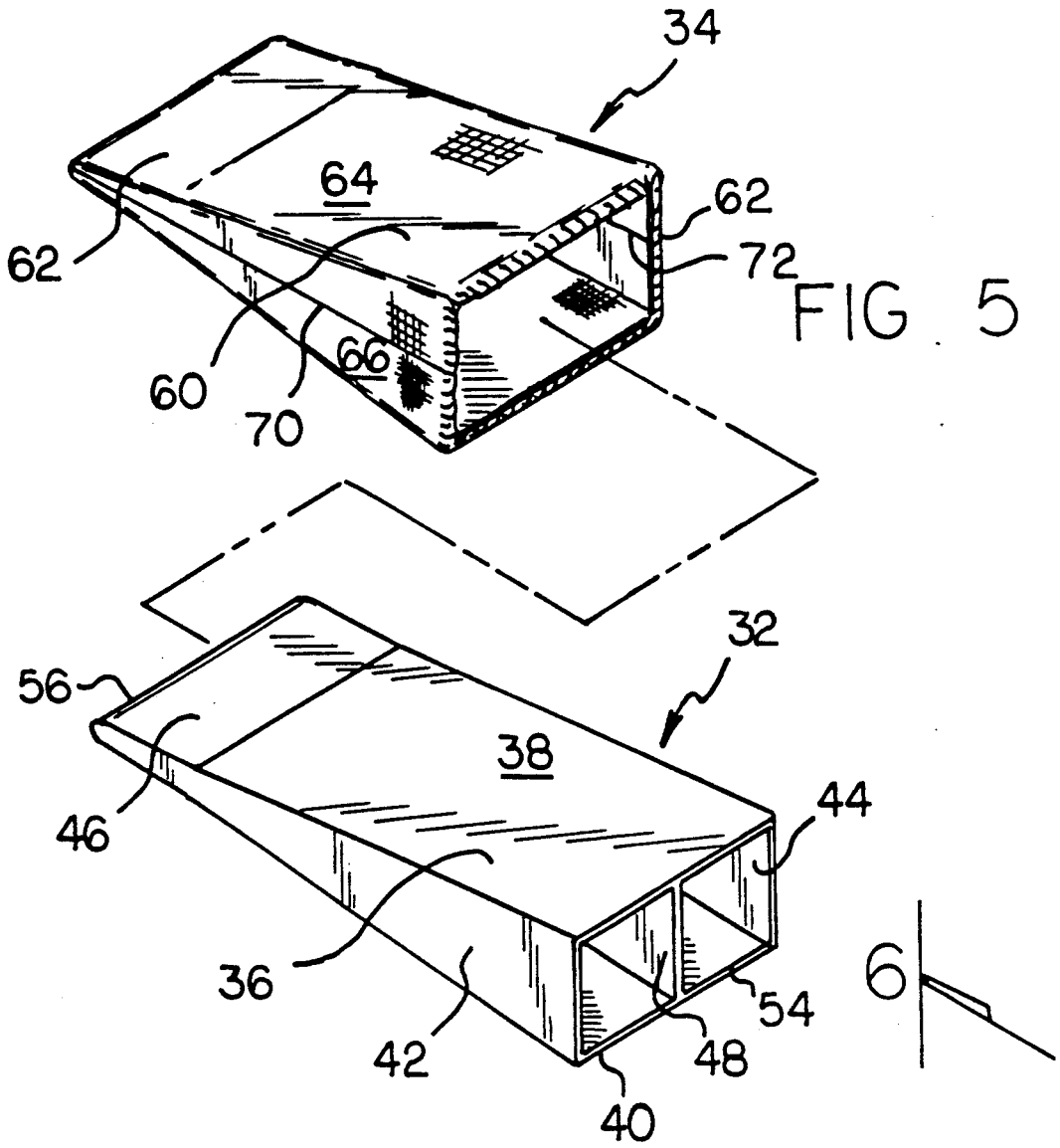
FIG. 5 is a perspective assembly view showing the various parts of the embodiment of FIGS. 3 and 4.
Figure 6:
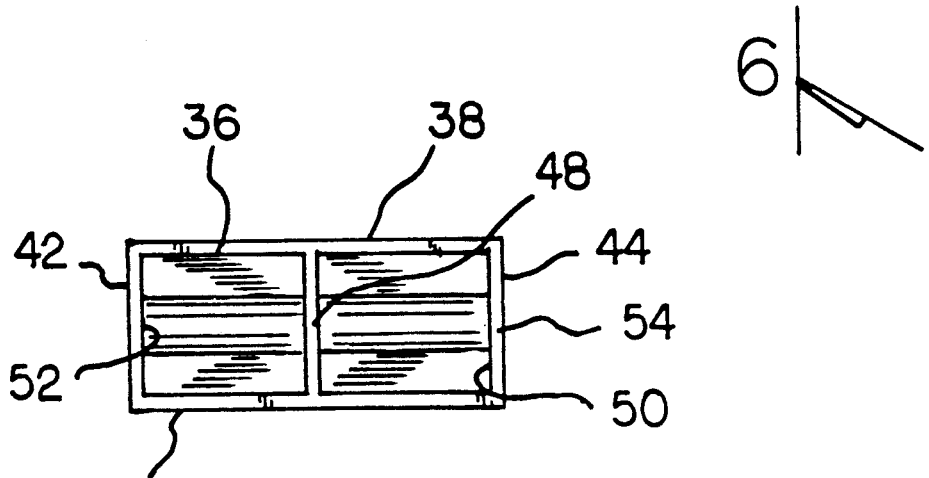
FIG. 6 is a cross-sectional elevational view taken along line 6—6 of FIG. 5.

As best seen in FIGS. 5 and 6, the rigid support member 32 comprises a substantially wedge shaped base portion 36 having opposed rectangular shaped top and bottom walls 38, 40 and opposed side walls 42, 44 which latter have a triangular shape such that the base portion tapers toward and is integrally joined with a narrow rectangular shaped tip portion 46. The support member 32 is hollow but for a longitudinally extending partition or dividing wall 48 substantially centrally located within the interior defined by the hollow support member. Hence, partition 48 divides the hollow interior of the support member into a pair of side-by-side axially or longitudinally extending compartments 50, 52 substantially as shown. The rightmost or larger end of the support member is open and is defined by end edge 54. Thus, as will be evident, the fingers of a user's hand may be placed into the interior of compartments 50, 52 through the open end of base portion 36. In the preferred arrangement, the forefinger and the index finger will be insertable in one compartment with the remaining two fingers insertable in the second compartment; however, it will be understood that whatever arrangement is comfortable to the user will suffice. It is even conceivable, and within the contemplation of the present invention, that the base portion of the support member may be gripped by a user with the latter's thumb insertable in one of the compartments and engaging partition 48. By virtue of the above tapered configuration of the support member 32, a plane passing through the base portion 36 parallel to its open end will intercept the walls thereof in the rectangular shape shown in FIG. 6 whereas the interception of a second plane passing through the base portion orthogonal to the first mentioned plane will have a triangular shape. It will be noted further that the extreme narrow or distal end of tip portion 46 is closed by a rounded or convex shaped end wall 56.

In accordance with the invention, support member 32 is rigid, lightweight, and durable and thus, may be fabricated from any suitable material imparting these characteristics, such as for example, metal, wood, plastic, or cardboard, with a molded transparent polymeric or plastic material being mostly preferred.

Flexible cover member 34 is suitably sized and shaped as a mitt or glove to be fitted snugly about rigid support member 32 in its entirety with the exception of the latter's open end and thus, has a first portion 60 corresponding to base portion 36, and an integral second portion 62 corresponding to tip portion 46. First portion 60, in turn, has a circumferentially extending peripheral pocket 62 at its open end in which an elastic band (not shown) or the like is disposed for circumferentially tightening the open end sufficiently to securely maintain the cover on the support member, yet permit easy removal of the cover so that it may be cleaned or replaced. In accordance with another feature of the invention, the cover is fabricated of two dissimilar materials or sections, the first section 64 comprising a suitable fabric, preferably, terry cloth, for washing the surface of a windshield with the aid of a suitable cleaning substance or solution, and the second section 66 comprising a suitable smooth material for wiping dry or polishing the windshield surface with chamois being mostly preferred. In the preferred arrangement, the first and second sections of dissimilar material are sewn or otherwise attached together along a pair of opposed seams 70, 72 substantially as shown in FIG. 5.

In use, the windshield cleaner is gripped by the fingers of the user's hand inserted into compartments 50, 52 with the thumb simultaneously engaging and gripping the bottom or side wall (and the corresponding overlying cover portion). By appropriately orienting the windshield cleaner 30, i.e. with either the terry cloth section 64 or the chamois section 66 facing the inside windshield surface, wiping movements may be made to efficiently clean or dry/polish the engaged surface of the windshield indicated in FIG. 3. Because of the unique wedged shape of windshield cleaner 30 the difficult to reach portions of the inside windshield surface especially in the region of the windshield's junction with the top of the automobile dashboard may effectively be treated. In addition, the rigid nature of the support member and the shape of same assures that a relatively large area of the cover material is maintained in direct, uniform contact with the confronting surface of the windshield over a relatively wide area as the user makes wiping movements with his/her hand. When the cleaning and drying/polishing process is completed, the cover 32 may easily be removed from the support member and either cleaned so as to be reused, or discarded in favor of a new replacement cover fitted over the support member for subsequent use.

Figure 7:
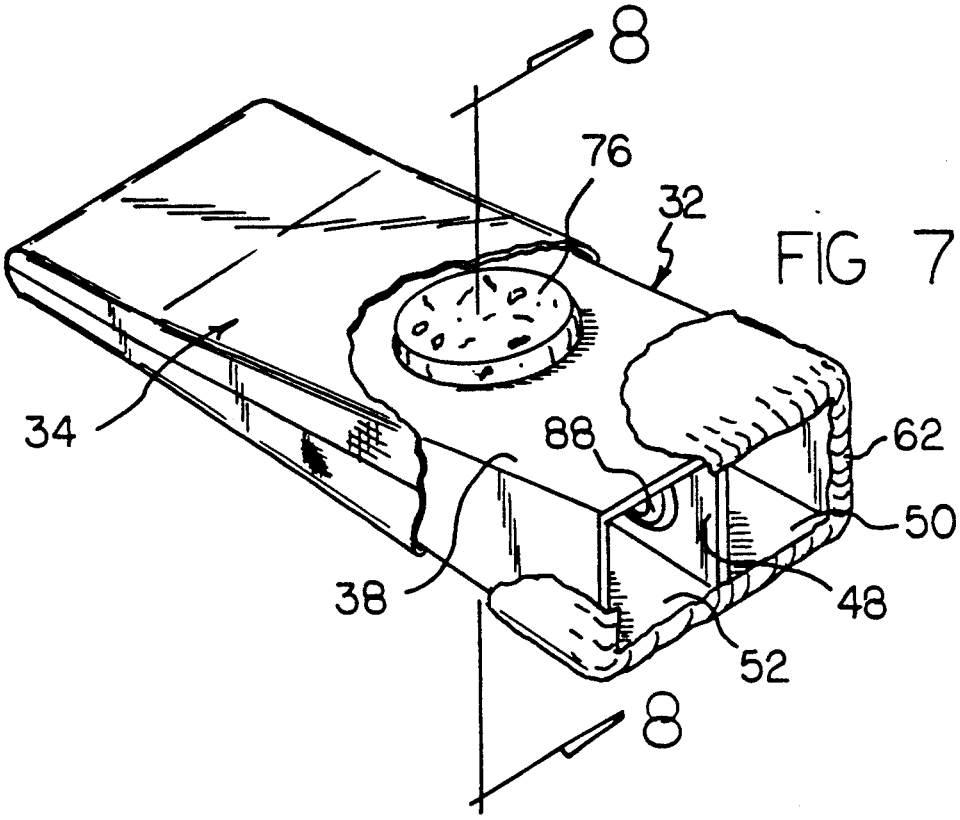
FIG. 7 is a perspective view of an alternatively preferred form of the present invention.
Figure 8:
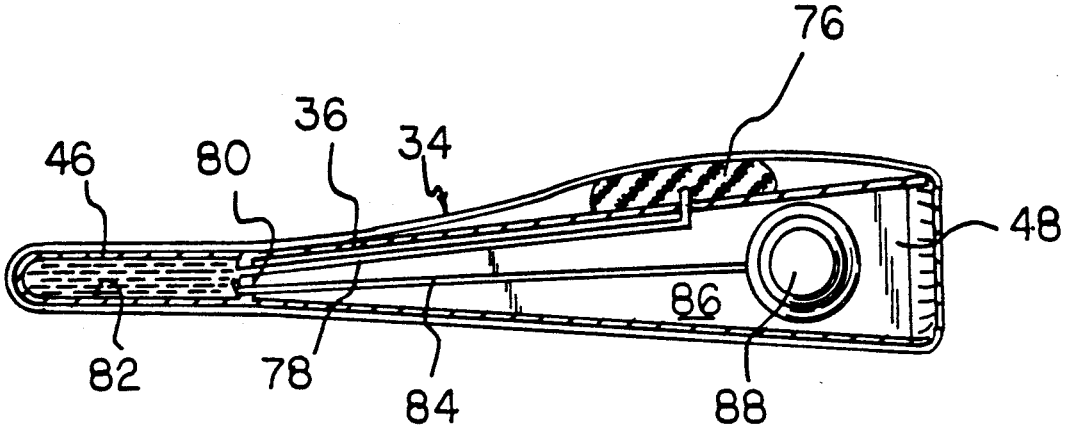
FIG. 8 is a cross-sectional elevational view taken along line 8—8 of FIG. 7.

It will be appreciated that any conventional cleaning substance or solution or other surface treating substance may be employed with the windshield cleaner embodiment described above. Turning now to FIGS. 7 and 8, an alternatively preferred embodiment will be described wherein like reference numerals represent like parts, and wherein self-contained cleaning substance supply means are provided.

A cleaning substance applicator preferably in the form of an absorbent pad or sponge 76, is suitably affixed to the outer surface of top wall 38 of support member 32 substantially as shown. A first supply tube 78 extends from the interior of the applicator 76 through a transverse end wall 80 which divides the interior of the tip portion from the base portion interior thereby defining a supply chamber or reservoir 82 located in the interior of tip portion 46 (see FIG. 8). A second supply tube 84 extends from chamber 82 through wall 80 along the side surface 86 of partition 48 and ultimately is connected to the interior of a conventional flexible, compressible bulb 88 suitably affixed to the partition sidewall surface near the entrance of compartment 52 substantially as shown. By this construction, compression of the bulb 88 by the thumb of the user's hand, for example, causes air to be forced through second supply tube 84 into the chamber 82 which in turn, causes a predetermined quantity of cleaning substance to flow from the chamber 82 through first supply tube 78 into applicator or sponge 76. Subsequent pressure of windshield cleaner 32 against the surface of the windshield being cleaned thus causes compression of the applicator and dispersal of the cleaning substance therein through the cover 34 and onto the windshield surface. This process may be repeated as long as there remains a supply of cleaning substance in the supply reservoir 82. In this regard, a suitable refilling nozzle (not shown) may be provided to recharge the supply chamber 82 with replacement substance as and when necessary.

Finally, it will be appreciated that the term "cleaning substance" as used in the above description and in the appended claims is to be broadly construed to embrace waxes, soaps, detergents, degreasers, solvents and any other compounds, solutions, etc. that may be applied to a surface for the purpose of cleaning, polishing, or treating same, or in any way altering the appearance thereof. Likewise, although the present invention has been particularly described in connection with preferred embodiments comprising a support member and a two-part flexible cover thereon, it will be understood that the invention is broad enough to cover the use of other forms of coverings or attachments to the support member including, but not limited to, sand paper, steel wool mats, wire brushes, impregnated pads and so.

It is apparent from the above that the present invention accomplishes all of the objectives set forth by providing a new and improved windshield cleaner that is low in cost, relatively simple in design and operation, and which may advantageously be used in awkward and hard to reach work spaces by a user to treat the surface of an article and control the application of a surface treating substance to the surface of the article, particularly the inside surface of an automobile windshield.

With respect to the above description, it should be realized that the optimum dimensional relationships for the parts of the invention, to include variations in size, materials, shape, form, function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein. Hence, the proper scope of the present invention should be determined only by the broadest interpretation of the appended claims so as encompass all such modifications and equivalents.

What is claimed as being new and desired to be protected by Letters Patent of the United States is as follows:

1. A new and improved windshield cleaner comprising:

a rigid support member, said rigid support member having a wedge shape tapering from a base portion to a tip portion, a flexible cover member in the general shape of a mitt, said cover member adapted to be fitted about said rigid support member with the end of said base portion being open, said rigid support member being hollow to define an interior communicating with said open end of said base portion, and partition means dividing said interior into at least first and second compartments whereby a user may grip said cleaner with the fingers of the user's hand insertable into said compartments and with the thumb of said user's hand engaging a portion of the outside surface of said base portion through a corresponding portion of said flexible cover member, and wherein said base portion has a rectangular cross-section in a first plane passing through said base portion parallel to the open end thereof and has a triangular cross-section in a second plane passing through said base portion orthogonal to said first plane.

2. The invention of claim 1 wherein said flexible cover member includes attachment means for permitting said flexible cover member to be removed and/or replaced.

3. The invention of claim 2 wherein said removable attachment means comprises a circumferential pocket disposed in said flexible cover member adjacent said open end of said base portion, and elastic means in said pocket.

4. The invention of claim 3 wherein said flexible cover member comprises at least first and second sections of dissimilar material.

5. The invention of claim 4 wherein said first section comprises terry cloth and said second section comprises chamois.

6. The invention of claim 1 further comprising cleaning substance supply means on said base portion, applicator means between said base portion and said flexible cover member first conduit means connected between said supply means and said applicator means, and activatable means for causing said substance to flow from said supply means to said applicator means.

7. The invention of claim 6 wherein said activatable means comprises a compressible, flexible bulb on said partition means in one of said first or second compartments and second conduit means connected between said supply means and said bulb.

8. The invention of claim 6 wherein said supply means comprises a transverse wall dividing said tip portion from said base portion, and said first conduit means extends through said transverse wall.

9. The invention of claim 1 wherein the transverse extent of said tip portion is the same as the transverse extent of said base portion.

* * * * *